US006488266B2

(12) United States Patent
Macor

(10) Patent No.: US 6,488,266 B2
(45) Date of Patent: Dec. 3, 2002

(54) PRYING BAR WITH TRANSITIONAL PORTION

(75) Inventor: Richard J. Macor, Hunterdon County, NJ (US)

(73) Assignee: Proprietary Technologies, Inc., Hunterdon County, NJ (US)

( * ) Notice: Subject to any disclaimer, the term of this patent is extended or adjusted under 35 U.S.C. 154(b) by 19 days.

(21) Appl. No.: 09/828,434

(22) Filed: Apr. 9, 2001

(65) Prior Publication Data

US 2002/0145135 A1 Oct. 10, 2002

(51) Int. Cl.[7] ..... B66F 3/00

(52) U.S. Cl. ..... 254/25

(58) Field of Search ..... 254/15, 17, 25, 254/131, 131.5, 134, DIG. 3; 294/57, 58, 167; 16/110 R, 114 R, 114 A, 115; 29/267

(56) References Cited

U.S. PATENT DOCUMENTS 5,447,289 A * 9/1995 Callahan ..... 254/131

* cited by examiner

*Primary Examiner*—Robert C. Watson

(57) ABSTRACT

A prying bar is described which comprises an elongated portion which has a longitudinal reference axis and is longer than any other portion of the prying bar. The prying bar also has a hook portion which is substantially U-shaped and has a tapered end which defines an imaginary reference line diverging outward relative to the longitudinal reference axis of the elongated portion at an angle equal to or less than 90.degree.. And, the prying bar has a transitional portion formed between the hook portion and the elongated portion. The transitional portion is not parallel to the longitudinal reference axis so that the elongated portion is positioned away from the tapered end of the hook so that clearance is provided for a user's hand to grasp the elongated portion when prying next to a work surface which is generally parallel to the longitudinal reference axis.

8 Claims, 3 Drawing Sheets

PRYING BAR WITH TRANSITIONAL PORTION

FIELD OF THE INVENTION

The present invention relates to hand tools, particularly prying bars for construction and wrecking applications.

BACKGROUND OF THE INVENTION

The conventional pry bar or "crow bar" has several functional disadvantages including the inability to work adjacent to an extended work surface which is generally parallel to the main, long portion of the bar. For example, the common crow bar can not be positioned for prying next to an extended, vertical and/or horizontal surface, such as a ceiling, wall or floor. Accordingly, the conventional crow bar can not be used to pry and remove baseboard moldings, ceiling moldings and the like. In addition, the conventional "crowbar" does not provide clearance for a user to grasp the main, long section of the bar when the bar is positioned adjacent to an extended work surface which is generally parallel to the main, long portion of the bar, and therefore, may not be used effectively for lifting objects having an extended vertical work surface.

Subsequently, there have been prying bars configured to overcome the disadvantages of the conventional crow bar. Generally, these improved prying bars each include a long main portion defining an imaginary, longitudinal reference axis. Also, each improved bar has a hook portion with a tapered end defining an imaginary line which intersects the longitudinal reference axis at an angle generally equal to, or greater than 90.degree.. This improved configuration does provide the user with clearance to grasp the prying bar when positioned adjacent to an extended work surface which is generally parallel to the main, long portion of the bar. However, when these bars are used alternatively to lift an object, a user must grasp a portion of the bar formed vertically relative to the ground, making it difficult for a user to lift and/or hold objects vertically.

SUMMARY OF THE INVENTION

The present invention involves a prying bar with a transitional portion formed between an elongated portion and a hook portion. The transitional portion is formed to enhance the function of both the hook portion and the elongated portion and also overcome the disadvantages of conventional prying bars.

The present invention more specifically involves a prying bar which comprises an elongated portion which has an imaginary longitudinal reference axis, and is longer than any other portion of the prying bar. The prying bar also has a hook portion which is substantially U-shaped and has a tapered end which defines an imaginary reference line diverging outward relative to the imaginary longitudinal reference axis at an angle equal to or less than 90.degree.. And, the prying bar has a transitional portion formed between the hook portion and the elongated portion. The transitional portion is not parallel to the longitudinal reference axis so that the elongated portion is positioned offset and away from the tapered end of the hook so that clearance is provided for a user's hand to grasp the elongated portion when prying next to an extended work surface which is generally parallel to the longitudinal reference axis. In some preferred embodiments, the transitional portion of the present invention is further enhanced for a user to grasp during lifting.

The present invention has been developed recognizing the need to configure a prying bar which will overcome the disadvantages of conventional prying bars. Accordingly, it is an important objective of the present invention prying bar described herein that it work well when positioned adjacent to an extended work surface which is generally parallel to the imaginary longitudinal reference axis of the bar, as defined herein. Thus, it is important that a user be able to grasp and pull the prying bar when working adjacent to an extended horizontal and/or vertical work surface, such as a ceiling, wall or floor.

It is another objective of the present invention that it be configured for alternative use by a user for lifting and/or holding objects vertically.

It is another objective of the present invention that it be configured for alternative use by a user with one end of the elongated portion exposed for striking with a striking means such as a hammer.

It is yet another objective of the present invention that it be commercially viable, simple in design, and cost efficient to manufacture.

DETAILED DESCRIPTION OF THE DRAWINGS

Figure 1:
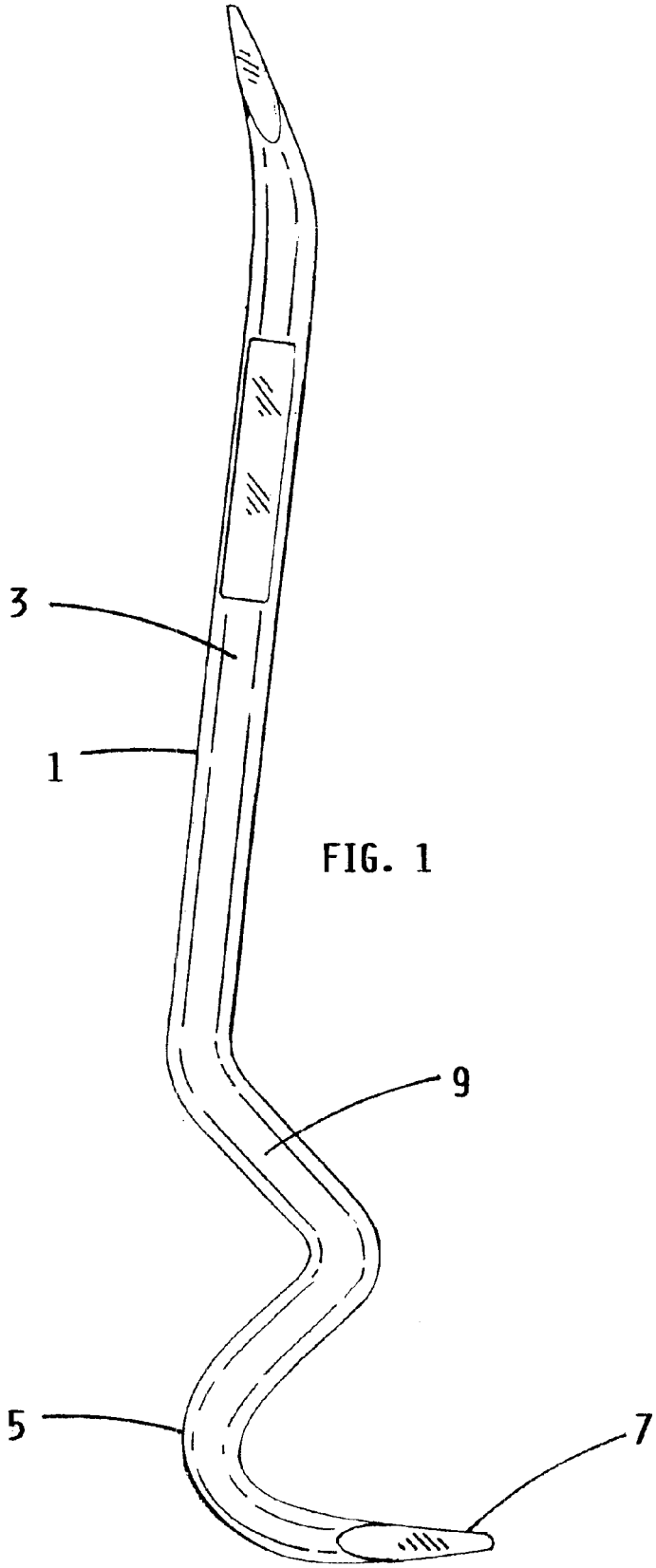
FIG. 1 shows a side elevation view of a present invention prying bar.

Referring now to the drawings which are for the purpose of illustrating preferred embodiments of the present invention and not for the purpose of limiting same, FIG. 1 shows a side elevation view of a present invention prying bar 1, having elongated portion 3, a hook portion 5 which has a tapered end 7, and a transitional portion 9 between elongated portion 3 and hook portion 5. The novel shape of the present invention prying bar shown here provides many advantages over other conventional prying bars.

Figure 2:
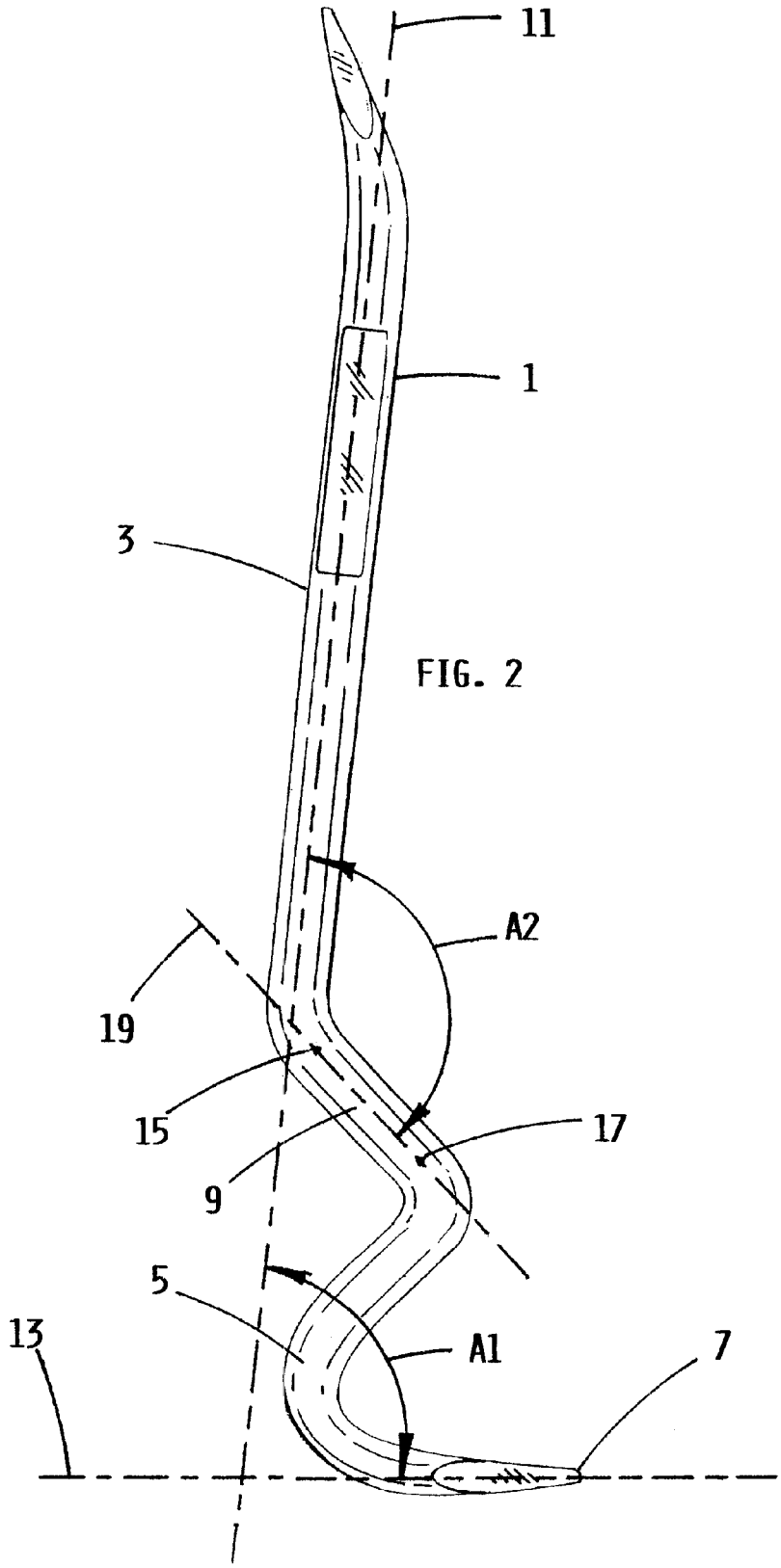
FIG. 2 shows a side elevation view of the prying bar shown in FIG. 1 showing more detail; and, FIG. 3 shows a present invention prying bar being operated by a user to pry an object with an extended vertical face; and, FIG. 4 shows a present invention prying bar being operated by a user to lift and/or carry an object; and, FIG. 5 shows a side elevation view of a present invention prying bar and a top elevation view of a hammer striking an exposed end of the elongated main portion of the bar.

FIG. 2 shows a side elevation view of the prying bar shown in FIG. 1 showing more detail. As seen in this Figure, prying bar 1 comprises an elongated portion 3 which has a longitudinal reference axis 11 and is longer than any other portion of prying bar 1. The prying bar also has a hook portion 5 which is substantially U-shaped and has a tapered end 7 which defines an imaginary reference line 13 which diverges outward relative to the longitudinal reference axis 11 of elongated portion 3 at an angle A1 which is about 84.degree.. Generally in all embodiments of the present invention, this angle A1 is less than 90.degree.. Transitional portion 9 is shown here formed between elongated portion 3 and hook portion 5. Transitional portion 9 is formed to enhance the function of both the hook portion 5 and the elongated portion 3, and also to overcome the disadvantages associated with conventional pry bars. As can be seen, transitional portion 9 is not parallel to the longitudinal reference axis 11 so that the elongated portion 3 is positioned offset and away from the tapered end 7 of hook portion 5. By forming prying bar 1 in this way, clearance is provided for a user's hand to grasp the elongated portion when prying next to surfaces which are generally parallel to the longitudinal reference axis 11. In this embodiment, transitional portion 9 can be further defined by imaginary reference line 19, and imaginary reference line 19 can be defined by two imaginary points 15 and 17 with one point positioned at each end of transitional portion 9. As can be seen, imaginary reference line 19 of transitional portion 9 intersects longitudinal reference axis 11 forming an obtuse angle A2 which is about 132.degree.. Transitional portion 9 may be slightly curved or straight as shown here. Generally in all embodiments of the present invention, this angle A2 is within the range of 100.degree. through 160.degree. inclusive. In some preferred embodiments, the transitional portion of the present invention is further enhanced for a user to grasp during lifting. Accordingly, the transitional portion is formed with a length sufficient for a user to fully grasp with at least one hand. And, in the same or other embodiments of the present invention, longitudinal reference axis 11 does not intersect any part of hook portion 5 so as to provide clearance for the striking of an end of elongated portion 3 where it joins transitional portion 9, with a striking means.

Figure 3:
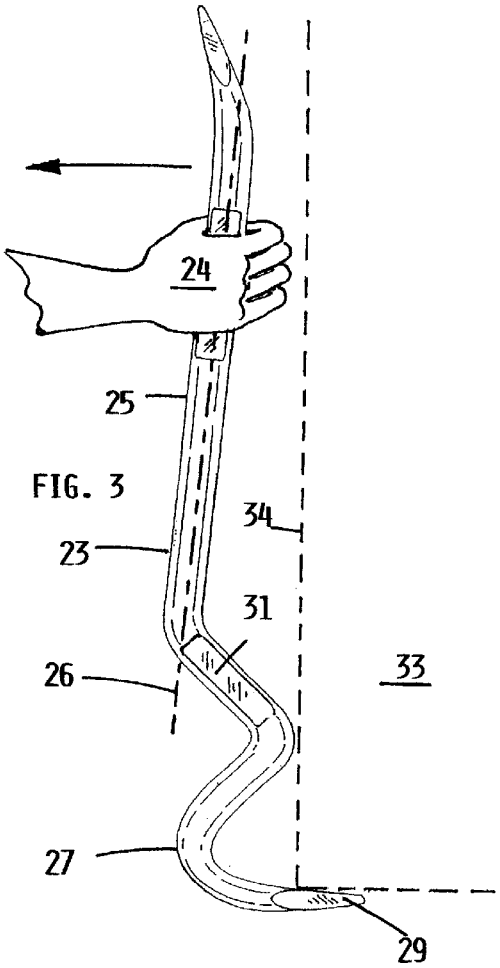

FIG. 3 shows a present invention prying bar 23 being operated by a user to pry an object 33 which has a vertical face 34, whereas, a user's hand 24 is shown pulling on prying bar 23. Prying bar 23 is formed having an elongated portion 25 which is defined by longitudinal reference axis 26. Prying bar 23 also includes a hook portion 27 which has a tapered end 29. Transitional portion 31 is formed between hook portion 27 and elongated portion 25 and is not parallel to longitudinal reference axis 26. Transitional portion 31 is formed so as to position elongated portion 25 away from the tapered end 29 of hook 27 so that clearance is provided for a user's hand 24 to grasp elongated portion 25 when prying next to a surface 34 which is generally parallel to the longitudinal reference axis 26 as shown here. Present invention prying bar 23 is formed providing many advantages over conventional prying bars, including the ability to pry next to a surface which is generally parallel to the imaginary reference axis of the elongated portion as defined herein, for example, next to floors, walls, ceilings etc.

Figure 4:
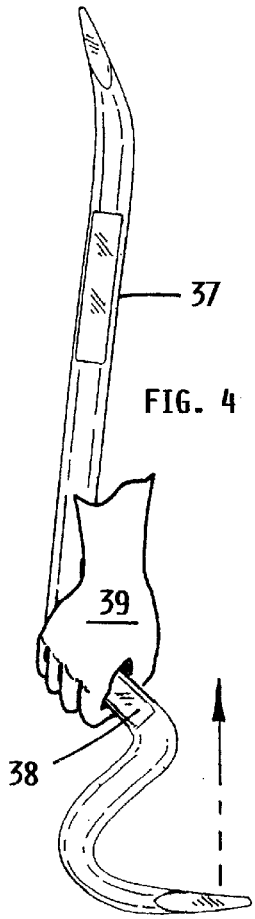

FIG. 4 shows a present invention prying bar being operated by a user to lift and/or carry an object (not shown), whereas, a user's hand 39 is shown gripping transitional portion 38 of prying bar 37. Again, transitional portion 38 is formed with a length sufficient for a user to fully grasp with at least one hand. Transitional portion 38 is also formed at an angle which provides a user with superior ergonomics when pry bar 37 is used alternatively to lift and/or hold an object vertically.

Figure 5:
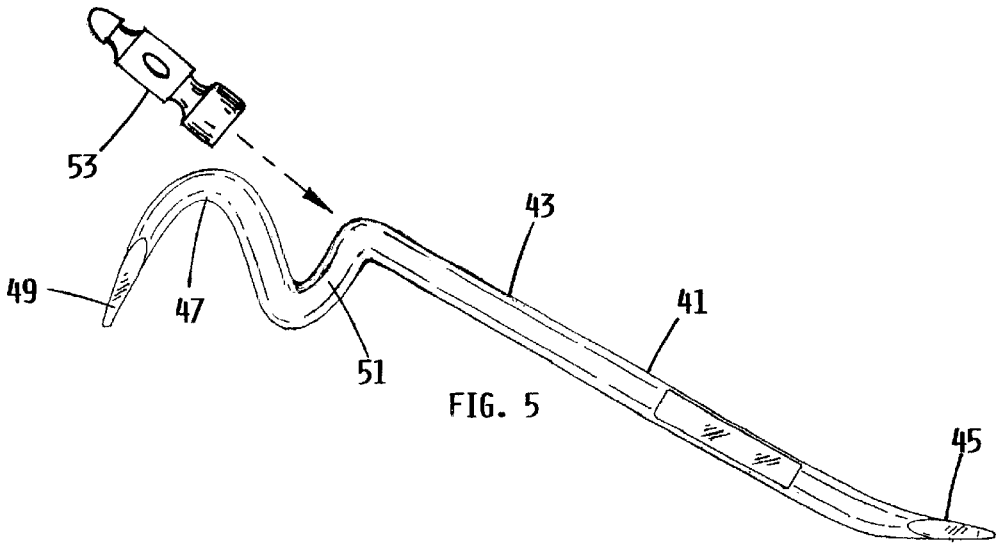

FIG. 5 shows a side elevation view of a present invention prying bar 41 and a top elevation view of a hammer 53 striking an end of the elongated portion 43 of prying bar 41. Prying bar 41 has elongated portion 43 which has a tapered chisel-like end 45 and a hook portion 47 which has a tapered end 49. Transitional portion 51 is formed between elongated portion 43 and hook portion 47. In this embodiment, transitional portion 51 is slightly curved. The present invention includes a transitional portion which may be curved or straight, however, it is always formed between the elongated portion and hook portion as defined herein. This novel, added value feature allows a user to strike an exposed end of the elongated portion 43 to drive the tapered working end 45 of elongated portion 43 under or between the work piece to facilitate the work operation.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A prying bar comprising:

(a) an elongated portion having an imaginary longitudinal reference axis, and being longer than any other portion of said prying bar; and, (b) a hook portion being substantially U-shaped and having a tapered end defining an imaginary reference line diverging outward relative to said longitudinal reference axis at an angle equal to or less than 90.degree., said hook portion further being formed wherein said longitudinal reference axis does not intersect any part of said hook portion so as to provide clearance for the striking of an end of said elongated portion with a striking means; and, (c) a transitional portion being formed between said hook portion and said elongated portion, said transitional portion not being parallel to said longitudinal reference axis and positioning said elongated portion away from said tapered end of said hook, whereas, sufficient clearance is provided for a user's hand to grasp said elongated portion when said prying bar is positioned next to an extended work surface being generally parallel to said longitudinal reference axis.

2. A pry bar of claim 1, wherein said transitional portion is substantially curved.

3. A pry bar of claim 1, wherein said transitional portion is substantially straight.

4. A prying bar comprising:

(a) an elongated portion having an imaginary longitudinal reference axis, and being longer than any other portion of said prying bar; and, (b) a hook portion being substantially U-shaped and having a tapered end defining an imaginary reference line diverging outward relative to said longitudinal reference axis at an angle equal to or less than 90.degree, said hook portion further being formed wherein said longitudinal reference axis does not intersect any part of said hook portion so as to provide clearance for the striking of an end of said elongated portion with a striking means; and, (c) a transitional portion being formed between said hook portion and said elongated portion, said transitional portion not being parallel to said longitudinal reference axis and positioning said elongated portion away from said tapered end of said hook, whereas, sufficient clearance is provided for a users hand to grasp said elongated portion when said prying bar is positioned next to an extended work surface being generally parallel to said longitudinal reference axis, and, further whereas said transitional portion is formed with a sufficient length for a user to fully grasp with at least one hand, whereby, said prying bar may also be used to lift an object.

5. A pry bar of claim 4, wherein said transitional portion is substantially curved.

6. A pry bar of claim 4, wherein said transitional portion is substantially straight.

7. A prying bar comprising:

(a) an elongated portion having an imaginary longitudinal reference axis, and being longer than any other portion of said prying bar; and, (b) a hook portion being substantially U-shaped and having a tapered end defining an imaginary reference line diverging outward relative to said longitudinal reference axis at an angle less than 90.degree., said hook portion further being formed wherein said longitudinal reference axis does not intersect any part of said hook portion so as to provide clearance for the striking of an end of said elongated portion with a striking means; and, (c) a transitional portion being formed between said hook portion and said elongated portion, said transitional portion not being parallel to said longitudinal reference axis and positioning said elongated portion away from said tapered end of said hook, whereas, sufficient clearance is provided for a user's hand to grasp said elongated portion when said prying bar is positioned next to an extended work surface being generally parallel to said longitudinal reference axis, said transitional portion being defined by an imaginary reference line and said imaginary reference line being defined by two imaginary points with one point at each end thereof, said imaginary reference line intersecting said longitudinal reference axis forming an obtuse angle within the range of 100.degree. through 160.degree. inclusive, and, further whereas said transitional portion is formed with a sufficient length for a user to fully grasp with at least one hand, whereby, said prying bar may also be used to lift an object.

8. A prying bar of claim 7, wherein said elongated portion has a gripping portion and said gripping portion has a cross sectional shape which is elongated.

* * * * *